US006754937B1

(12) United States Patent
Martin

(10) Patent No.: US 6,754,937 B1
(45) Date of Patent: Jun. 29, 2004

(54) MEMO CLIP WITH MOUNTING PINS

(75) Inventor: Robert Martin, Washington, MO (US)

(73) Assignee: Magnet, LLC, Washington, MO (US)

( * ) Notice: Subject to any disclaimer, the term of this patent is extended or adjusted under 35 U.S.C. 154(b) by 0 days.

(21) Appl. No.: 10/340,255

(22) Filed: Jan. 10, 2003

(51) Int. Cl.[7] ..... A44B 1/04

(52) U.S. Cl. ..... 24/351; 24/354; 248/229.13; 248/229.23; 248/316.5

(58) Field of Search ..... 24/351, 354, 511; 16/4; 248/682, 316.5, 229.13, 229.23

(56) References Cited

U.S. PATENT DOCUMENTS

| | | | | | |
|---|---|---|---|---|---|
| 305,001 | A | * | 9/1884 | Hitt | 24/46 |
| 382,480 | A | | 5/1888 | Lines | |
| 501,652 | A | | 7/1893 | Haskell | |
| 580,675 | A | * | 4/1897 | Hanson | 16/4 |
| 591,835 | A | * | 10/1897 | Gosewisch | 24/334 |
| 637,889 | A | | 11/1899 | Parker et al. | |
| 726,975 | A | * | 5/1903 | Neithercott | 24/5 |
| 730,663 | A | * | 6/1903 | Jordan | 24/13 |
| 803,464 | A | | 1/1905 | Beck | |
| 1,149,444 | A | | 8/1915 | Hodgson | |
| 1,202,412 | A | * | 10/1916 | O'Donnell | 24/354 |
| 1,222,540 | A | * | 4/1917 | Lauletta | 74/521 |
| 1,472,471 | A | | 1/1923 | Hope | |
| 1,468,884 | A | * | 9/1923 | Schneider | 24/501 |
| 1,476,380 | A | | 12/1923 | Toepper | |
| 1,496,601 | A | | 6/1924 | Reinhart | |
| 1,860,384 | A | | 5/1932 | Cocks | |
| 2,261,089 | A | * | 10/1941 | Kurtz | 24/504 |
| 2,471,606 | A | * | 5/1949 | Burns | 24/501 |
| 2,732,602 | A | * | 1/1956 | Quimby | 24/66.8 |
| 2,837,806 | A | * | 6/1958 | Hawie | 24/328 |
| 4,253,216 | A | * | 3/1981 | Brown | 24/67 AR |
| 4,425,690 | A | * | 1/1984 | Fraser et al. | 24/351 |
| 4,860,402 | A | * | 8/1989 | Dichtel | 16/4 |
| 5,148,581 | A | | 9/1992 | Hartmann | |
| 5,236,760 | A | | 8/1993 | Jinn | |
| 5,441,188 | A | * | 8/1995 | Rosenstein | 224/264 |
| 5,500,987 | A | | 3/1996 | Rosen | |
| D405,828 | S | | 2/1999 | Richter | |
| D464,994 | S | | 10/2002 | Rosen | |

OTHER PUBLICATIONS

Magnet, LLC "Power Clip", circa 2000.
Norwood Promotional Products "Cubicle Clips".
Evans Manufacturing "Cubicle Clips".

* cited by examiner

*Primary Examiner*—Leslie A. Braun
*Assistant Examiner*—Amy J. Sterling
(74) *Attorney, Agent, or Firm*—Thompson Coburn LLP

(57) ABSTRACT

A memo clip with mounting pins for releasably holding articles to an adjacent object comprises a clamping portion and a mounting portion. The clamping portion has first and second clamping members operatively connected to one another and movable between an open position and a substantially closed position for releasably holding an article therebetween. A biasing member connected to the first and second clamping members biases them toward their closed position. The mounting portion of the clip is operatively connected to the clamping portion and has at least one mounting prong that is adapted for insertion in and securement to the adjacent object for mounting the clip to the adjacent object. The mounting prong is movable between a safety position with an insertion end of the prong substantially flush against the first clamping member and an in-use position with the insertion end spaced from the first clamping member to facilitate insertion of the mounting prong into the adjacent object.

17 Claims, 3 Drawing Sheets

MEMO CLIP WITH MOUNTING PINS

BACKGROUND OF THE INVENTION

The present invention relates generally to clipping or clamping devices and, more particularly, to a clip device that releasably holds an article, such as a paper memo, to an adjacent object, such as a bulletin board or fabric-covered office space divider.

The prior art is replete with devices for holding articles, such as paper memos, ink pens, envelopes, calendars, clip boards, caps, coats, etc., to a vertical surface, such as a wall or door. In a home or office environment, there is often a need to keep small items such as paper memos nearby for ready access or reference. Keeping these regularly used items visible, rather than in a drawer or file cabinet, reduces the likelihood of losing them and saves time when they need to be repeatedly accessed.

One crude but popular method of attaching articles to a vertical surface, such as a bulletin board or fabric-covered office space divider is using push pins or thumb tacks. However, pins and tacks permanently damage the article to be retained because the paper memo or other article must be pierced to be held, leaving unsightly poke holes. Push pins and thumb tacks are also limited in their use, and generally would not be appropriate for holding heavier or thicker articles such as pens, clip boards, thick envelopes, etc. In addition, push pins and thumb tacks pose a potential danger if they are dislodged from a bulletin board and fall to the ground, where they can be stepped or sat on.

Another prior art device for holding articles comprises a pair of clamping members connected to one another in a manner to operate generally like a clothes pin for clamping an article between the pair of clamping members. These devices have been used in conjunction with an adhesive member for adhesively attaching the device to a vertical surface, such as a wall or desk. These devices have also been used in conjunction with a magnetic member for magnetically attaching the device to a metallic surface, such as a file cabinet or a refrigerator door. Such clamping devices are generally effective without piercing or otherwise damaging the article to be held. However, these clamping devices have not been useful for releasably holding articles to cork or fabric-covered vertical surfaces, such as bulletin boards or office space dividers, where adhesives and magnets would generally be ineffective.

Thus, there is a need for a clipping or clamping device that is capable of safely and reliably holding a variety of articles to a cork, fabric covered, or other surface for which conventional magnetic and adhesive mounting members would be inappropriate.

SUMMARY OF THE INVENTION

It is a general object of the present invention to provide a clip or clamping device that is simple in construction, inexpensive to manufacture and capable of holding a variety of different articles to an adjacent surface. A related object of the present invention is to provide a clip or clamping device that can be readily affixed to a cork or fabric covered surface for releasably retaining an article to that surface. Still another object is to provide an article retaining device having one or more mounting prongs or pins that are adapted for insertion in and securement to an adjacent cork or fabric covered surface. A further object is to provide article retaining device having a built-in safety feature, which reduces the likelihood that a user will be injured by mounting prongs or pins of the device when the device is not in use affixed to the adjacent surface.

In general, a clip for releasably holding articles to an adjacent object comprises a clamping portion and a mounting portion. The clamping portion has first and second clamping members operatively connected to one another and movable relative to one another between a substantially closed position and an open position. In the substantially closed position, the first and second clamping members are adapted for releasably holding an article therebetween. In the open position, the first and second clamping members are adapted for releasing the article. The clamping portion also includes a biasing member connected to the first and second clamping members for biasing them toward their substantially closed position. The mounting portion of the clip is operatively connected to the clamping portion and adapted for mounting the clip to the adjacent object. The mounting portion has at least one mounting prong with an insertion end that is adapted for insertion in and securement to the adjacent object for mounting the clip to the adjacent object. The mounting prong is movably connected to the first clamping member of the clamping portion in a manner so that the mounting prong moves between a safety position and an in-use position. In the safety position, the insertion end of the mounting prong lies substantially flush against the first clamping member. In the in-use position, the insertion end of the mounting prong is spaced from the first clamping member in a manner to facilitate insertion of the mounting prong into the adjacent object to which the clip is to be mounted.

In another aspect of the invention, a clip for gripping articles and suspending them from an adjacent object comprises a clamping portion and a mounting portion. The clamping portion has first and second clamping members, each of which has a gripping end and a finger-engaging end. The first and second clamping members are pivotally connected to one another for pivoting movement about a pivot axis that is located between the respective gripping and finger-engaging ends of the first and second clamping members. The first and second clamping members are movable between a gripping position and an open position. In the gripping position, the gripping ends of the first and second clamping members are brought into engagement with one another. In the open position, the gripping ends of the first and second clamping members are spaced from one another. The clamping portion includes a spring that is operatively connected to the finger-engaging ends of the first and second clamping members. The spring urges the finger-engaging ends apart, thereby biasing the gripping ends of the first and second clamping members together for releasably holding an article therebetween. The mounting portion is connected to the clamping portion for mounting the clip to an adjacent object. The mounting portion has at least one mounting pin adapted for insertion in and securement to the adjacent object. The mounting pin is pivotally connected to the first clamping member in a manner so the mounting pin is pivotable between a safety position and an in-use position. In the safety position, the mounting pin is generally parallel and substantially flush with the first clamping member. In the in-use position, an insertion end of the mounting pin is spaced from the first clamping member to facilitate insertion of the pin into the adjacent object.

In still another aspect of the invention, an article holder for releasably holding an article from an adjacent object comprises an article-retaining body, a mounting portion, and a resilient member. The article-retaining body has an article-engaging portion adapted for releasably holding an article.

The mounting portion is operatively connected to the article-retaining body for mounting the article holder to the adjacent object The mounting portion has at least one mounting prong with an insertion end adapted for insertion in and securement to the adjacent object The mounting prong is pivotally connected to the article-retaining body in a manner so that it pivots between a safety position and in-use position. In a safety position, the insertion end of the mounting prong lies substantially flush against a portion of the article-retaining body. In the in-use position, the insertion end of the mounting prong is spaced from the article-retaining body. The resilient member is operatively connected to the article-retaining body and mounting portion for biasing the mounting prong toward its safety position.

Other objects and features of the invention will be in part apparent and in part pointed out hereinafter. While the principle advantages and features of the present invention have been described above, a more complete and thorough understanding and appreciation for the invention may be attained by referring to the drawings and description of the preferred embodiments, which follow.

Figure 1:
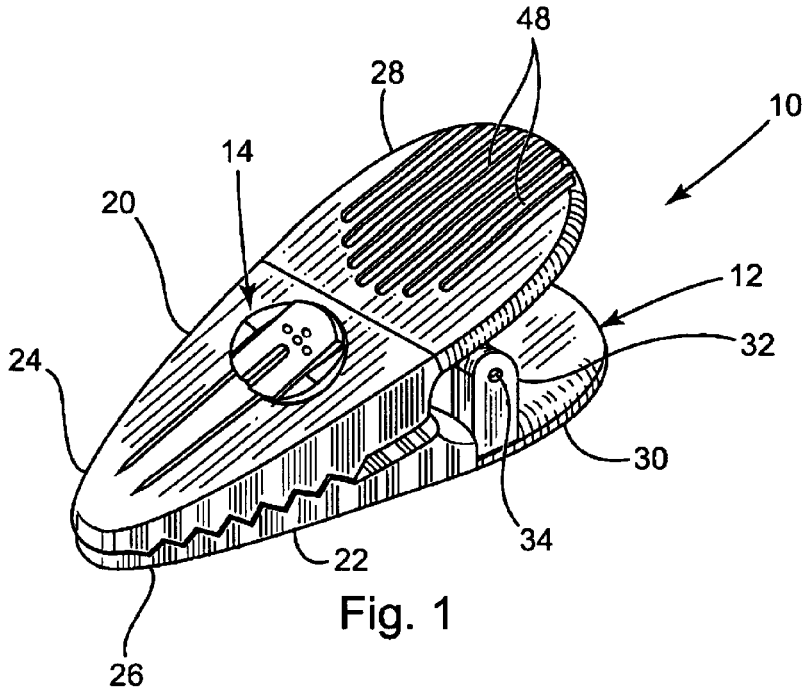
FIG. 1 is a perspective view of a memo clip with mounting pins of the present invention.

Reference characters shown in these Figures correspond to reference characters used throughout the detailed description of the preferred embodiments, which follows.

DETAILED DESCRIPTION OF THE PREFERRED EMBODIMENTS

A preferred embodiment of a clip of the present invention is represented generally in the Figures by the reference numeral 10. In general, the clip 10 comprises a clamping portion 12 and a mounting portion 14 which, as described hereinafter, operate together to releasably holds an article to an adjacent object.

Figure 5:
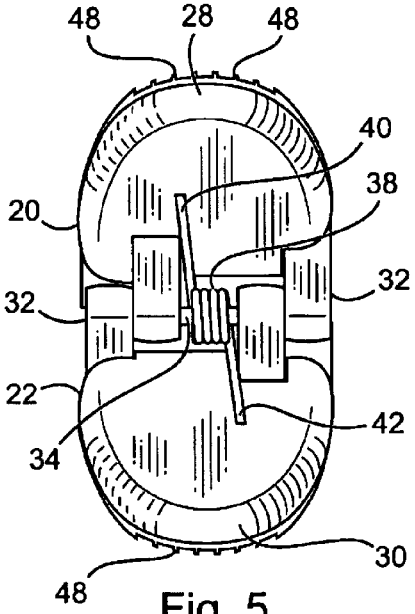
FIG. 5 is a rear elevational view of the memo clip with mounting pins of FIG. 1.
Figure 6:
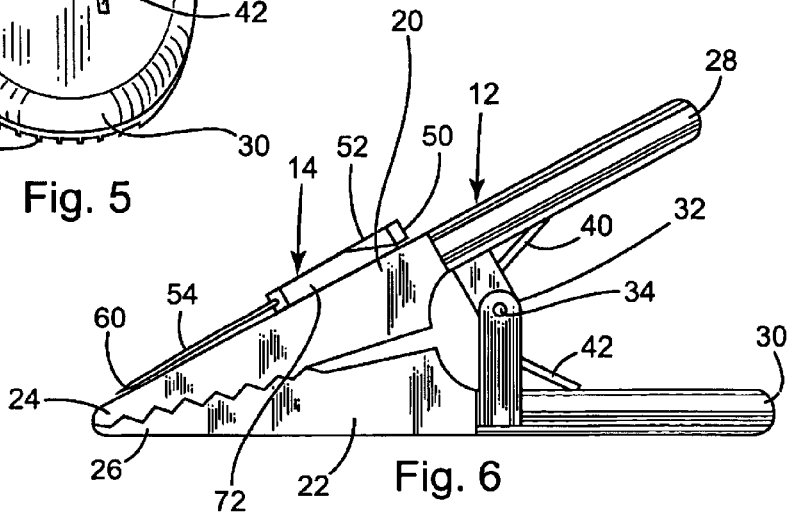
FIG. 6 is a right side elevational view of the memo clip with mounting pins of FIG. 1, with the mounting pins shown in a "safety" position, the left side elevational view being a mirror image thereof.

As shown in FIGS. 1, 5 and 6, the clamping portion 12 preferably has a first clamping member 20 and a second clamping member 22. Each of the first and second clamping members 20 and 22 preferably has a generally elongate configuration with a gripping end 24 and 26 and an opposite finger-engaging end 28 and 30, which are described in more detail below. Between the gripping and finger-engaging ends of each clamping member are a pair of hinge members 32 for operatively connecting the first and second clamping members 20 and 22. In the preferred embodiment of the invention, the hinge members 32 extend generally perpendicularly from the respective clamping members 20 and are connected by a pivot pin 34. The first and second clamping members 20 and 22 are thus pivotally connected to one another for pivoting movement about a pivot axis of the pivot pin 34 between a substantially closed position and an open position. In the substantially closed position, the gripping ends 24 and 26 of the first and second clamping members 20 and 22 are closed together and adapted for releasably holding an article between them. As the first and second clamping members 20 and 22 pivot relative to one another about the pivot pin 34, the gripping ends 24 and 26 can be moved apart from one another as the finger-engaging ends 28 and 30 move toward one another. Thus, in the open position of the clamping portion 12, the gripping ends 24 and 26 are spaced from one another for releasing an article held therein or for inserting an article to be held.

The clamping portion 12 preferably includes a biasing member 38 for biasing the first and second clamping members 20 and 22 toward their substantially closed position. As best shown in FIGS. 5 and 6, the biasing member 38 preferably comprises a coil spring having a first end 40 in engagement with an inner surface of the finger-engaging end 28 of the first clamping member 20, and a second end 42 in engagement with an inner surface of the finger-engaging end 30 of the second clamping member 22. The spring 38 urges the finger-engaging ends 28 and 30 apart from one another, thereby biasing the gripping ends 24 and 26 of the first and second clamping members 20 and 22 together for releasably holding an article therebetween. Thus, in operation, the clamping portion 12 of the clip 10 preferably operates in a manner similar to a "clothes pin."

Preferably, the finger-engaging portions 28 and 30 of the first and second clamping members 20 and 22 include a series of ridges 48 or other friction increasing features to enhance the user's manual engagement of these portions, and reduce the likelihood of the clip 10 slipping out of the user's hands when pressing the clamping members 20 and 22 together. The user uses his/her fingers to engage the finger-engaging portions 28 and 30 of the first and second clamping members 20 and 22 and presses the finger-engaging portions 28 and 30 toward one another, which causes the gripping ends 24 and 26 of the first and second clamping members 20 and 22 to move apart to release an article held therein or for inserting an article to be held.

While the clamping portion 12 has been described to this point as comprising a pair of cooperating clamping members 20 and 22 that operate like a "clothes pin," it should be understood that other clamping, gripping and retaining devices could be used in conjunction with the mounting portion 14 (described hereinafter) for holding paper memos and other articles without departing from the scope of the invention as defined by the appended claims.

Figure 2:
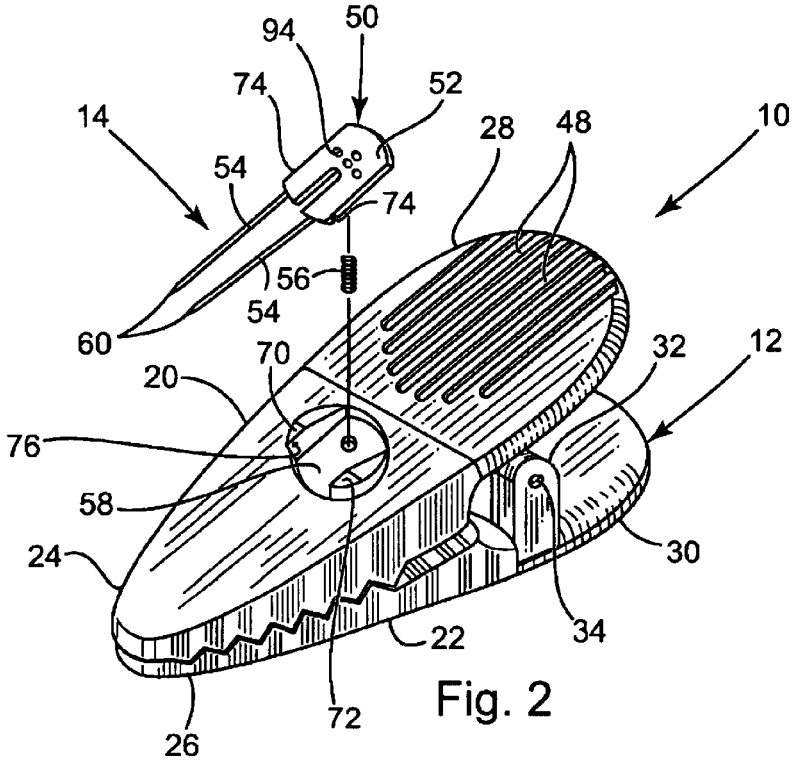
FIG. 2 is an exploded view of the memo clip with mounting pins of FIG. 1 showing certain internal and external components of the device.
Figure 3:
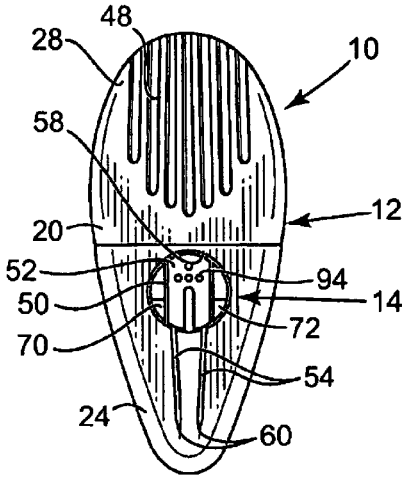
FIG. 3 is top plan view of the memo clip with mounting pins of FIG. 1.
Figure 4:
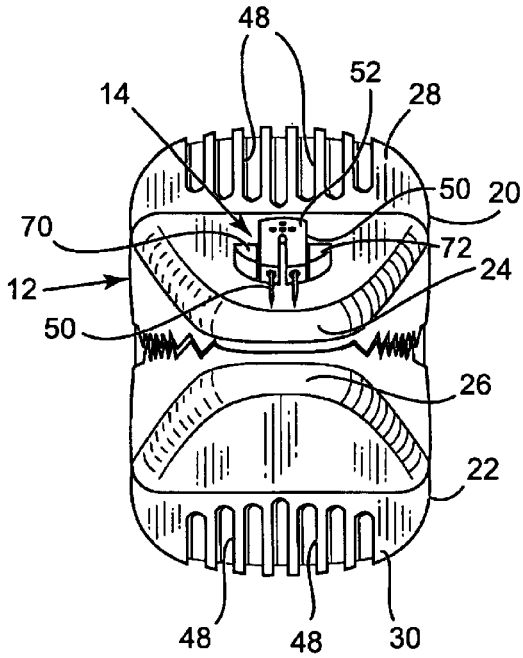
FIG. 4 is a front elevational view of the memo clip with mounting pins of FIG. 1.

The mounting portion 14 of the clip 10 is operatively connected to first clamping member 20 of the clamping portion 12, as described below, and is adapted for mounting the clip 10 to an adjacent object or surface. In general, the mounting portion 14 comprises a manual engagement portion 50 with a manual engagement surface 52, a pair of mounting prongs or pins 54 and a resilient member 56. FIG. 2 is an exploded view of these components. As shown in FIG. 2, the first clamping member 20 includes a generally cylindrical recess 58, which receives part of the mounting portion 14.

Figure 7:
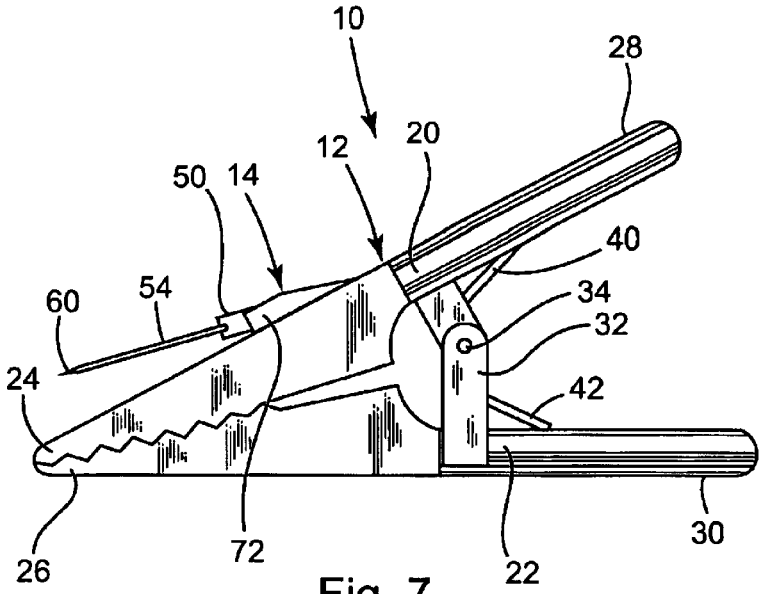
FIG. 7 is a right side elevational view similar to FIG. 4 but with the mounting pins shown in an "in-use" position.
Figure 8:
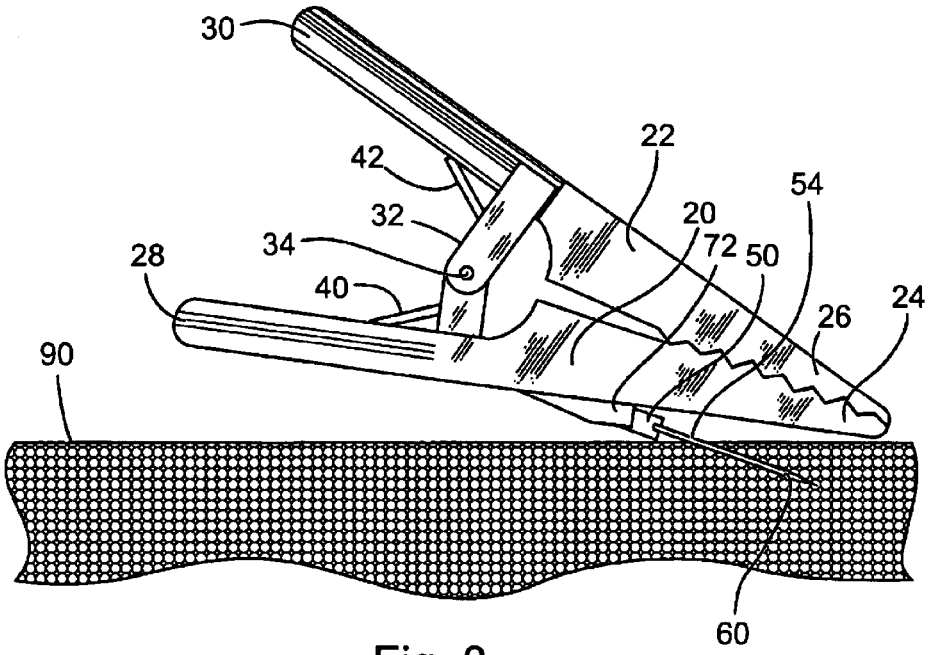
FIG. 8 is a side elevational view of the memo clip with mounting pins shown as mounted to an adjacent object.

As shown in the Figures, the mounting prongs or pins 54 extend from one end of the manual engagement portion 50 in a generally parallel fashion so that insertion ends 60 of the pins are generally pointed in the same direction, toward the gripping end 24 of the first clamping member 20. As best shown in FIG. 2, the mounting portion 14 of the clip 10 also includes first and second bearing members 70 and 72, which flank the recess 58. Preferably, the manual engagement portion 50 includes a pair of laterally opposite pivot pins 74 that are received in corresponding recesses 76 in the first and second bearing members 70 and 72 in a manner to permit pivoting movement of the manual engagement portion 50 and mounting pins 54 relative to the first clamping member 20 about a pivot axis of the pivot pins 74. As shown in FIGS. 6–8, the mounting pins 54 are moveable in this manner between a "safety" position (shown in FIG. 6) and an "in-use" position (shown in FIGS. 7 and 8). As shown in FIG. 6, in the "safety" position, the sharp insertion ends 60 of the mounting pins 54 lie substantially flush against an outer surface of the first clamping member 20. Thus, when not in use, the "safety" position of the sharp insertion ends 60 of the mounting pins 54 reduces the potential danger that may be posed by exposed pins, and reduces the likelihood that the pins 54 will become inadvertently snagged on another object or injure the user when the clip 10 is not in use. As shown in FIGS. 7 and 8, in the "in-use" position, the insertion ends 60 of the mounting pins 54 are spaced from the outer surface of the first clamping member 20 in a manner to facilitate insertion of the mounting pins 54 into the adjacent object or surface 90 (see FIG. 8) to which the clip 10 is to be mounted. Thus, as shown in FIG. 8, in the "in-use" position, the insertion ends 60 of the mounting pins 54 are inserted in and thereby secured to the adjacent surface 90 to mount the clip 10 thereto.

As shown in the exploded view of FIG. 2, the resilient member 56 is preferably positioned between the manual engagement portion 50 and the base of the recess 58 in the first clamping member 20. Preferably, the resilient member 56 is positioned on the rear side of the pivot pins 74 (i.e., the side opposite the mounting pins 54) so that the resilient member 56 urges the manual engagement portion 50 away from the first clamping member 20 and thereby biases the mounting portion 14 toward its "safety" position. As shown in FIG. 2, the resilient member 56 is preferably a compression spring, though other resilient devices could be used to bias the mounting portion 14 toward its "safety" position.

Thus, in operation, a user manually depresses the manual engagement surface 52 with enough force pivot the mounting portion 14 against the bias of the resilient member 58 so that the rear end of the manual engagement portion 50 moves into the recess 58 and the mounting pins 54 move away from the outer surface of the first clamping member 20. Preferably, the mounting pins 54 are rigidly connected to the manual engagement portion 50 so that they move with one another as a unit and manual movement of the manual engagement portion 50 by the user causes corresponding movement of the mounting pins 54 toward their "in-use" position against the bias of the resilient member 56. Also, preferably, the manual engagement surface 52 includes a plurality of friction recesses 94 or other friction increasing features to enhance the user's manual engagement of the manual engagement surface 52 and reduce the likelihood that the user's fingers will slip when pressing the manual engagement surface 52 to operate the mounting portion 14.

Again, FIG. 8 illustrates the "in-use" position of the mounting portion 14, with the insertion ends 60 of the mounting pins 54 spaced from the outer surface of the first clamping member 20 and inserted into the adjacent surface 90 to secure the clip 10 to thereto. The clip 10 is readily affixable to a cork or fabric covered surface, such as a bulletin board or fabric-covered office space divider (sometimes referred to as "cubicle" dividers), and can be used to releasably hold an article to that surface. The pivoting mounting portion 14 serves as an integral safety feature, which reduces the likelihood that the user will be injured by the mounting pins 54 when the clip 10 is not in use.

In view of the above, it will be seen that the several objects of the invention are achieved and other advantageous results obtained. As various changes could be made in the above constructions and uses without departing from the scope of the invention, it is intended that all matter contained in the above descriptions and shown in the accompanying drawings shall be interpreted as illustrative and not in a limiting sense. The invention therefore shall be limited solely by the scope of the claims set forth below.

What is claimed is:

1. A clip for releasably holding articles to an adjacent object, the clip comprising:

a clamping portion having first and second clamping members operatively connected to one another and movable relative to one another between a substantially closed position for releasably holding an article therebetween and an open position for releasing said article, and a biasing member connected to the first and second clamping members for biasing the first and second clamping members toward their substantially closed position; and a mounting portion operatively connected to the clamping portion adapted for mounting the clip to the adjacent object, the mounting portion having at least one mounting prong with an insertion end adapted for insertion in and securement to said adjacent object, said at least one mounting prong being moveably connected to the first clamping member in a manner so that the mounting prong is moveable between a safety position wherein the insertion end of the mounting prong lies generally parallel to substantially flush against the first clamping member and an in-use position wherein the insertion end of the mounting prong is spaced from the first clamping member, the mounting portion further comprising a resilient member for biasing the at least one mounting prong toward its safety position.

2. The clip of claim 1 wherein the resilient member is a compression spring.

3. The clip of claim 1 wherein said at least one mounting prong is pivotally connected to the first clamping member in a manner so that the mounting prong pivots relative to the first clamping member between its safety position and its in-use position.

4. The clip of claim 3 wherein the mounting portion includes a manual engagement surface operatively connected to the at least one mounting prong, the manual engagement surface being adapted for manual engagement by a user in a manner so that movement of the manual engagement surface by the user causes movement of the at least one mounting prong toward its in-use position against the bias of the resilient member, for mounting the clip to an adjacent object.

5. The clip of claim 1 wherein said mounting portion includes a pair of mounting prongs aligned generally parallel with one another and having insertion ends pointing generally in the same direction.

6. The clip of claim 5 wherein the mounting portion includes a manual engagement surface operatively connected to the pair of mounting prongs in manner so that movement of the manual engagement surface by a user causes the pair of mounting prongs to move toward their in-use position as a unit.

7. A clip for gripping articles and suspending them from an adjacent object, the clip comprising:

a clamping portion having first and second clamping members, each of the first and second clamping members having a gripping end and a finger-engaging end, the first and second clamping members being pivotally connected to one other for pivoting movement about a pivot axis located between the respective gripping and finger-engaging ends of the first and second clamping members, the first and second clamping members being moveable between a gripping position wherein the gripping ends of the first and second clamping members are brought into engagement with one another and an open position wherein the gripping ends of the first and second clamping members are spaced from one another, the clamping portion including a spring that is operatively connected to the finger-engaging ends of the first and second clamping members in a manner to urge the finger-engaging ends apart, thereby biasing the gripping ends of the first and second clamping members together for releasably holding an article therebetween; and a mounting portion connected to the clamping portion for mounting the clip to an adjacent object, the mounting portion having at least one mounting pin with an insertion end adapted for insertion in and securement to said adjacent object, the at least one mounting pin being pivotally connected to the first clamping member in a manner so that the mounting pin is pivotable between a safety position wherein the insertion end of the pin lies generally parallel to and substantially flush against the first clamping member and an in-use position wherein the insertion end of the mounting pin is spaced from the first clamping member to facilitate insertion of the pin into the adjacent object, the mounting portion further comprising a resilient member for biasing the mounting pin toward its safety position.

8. The clip of claim 7 wherein the mounting portion includes a manual engagement portion operatively connected to the mounting pin, the manual engagement portion being adapted for manual engagement by a user in a manner so that movement of the manual engagement portion by the user causes movement of the mounting pin toward its in-use position against the bias of the resilient member.

9. The clip of claim 8 wherein the resilient member is a compression spring positioned between the manual engagement portion and the first clamping member.

10. The clip of claim 7 wherein the mounting portion includes a pair of mounting pins aligned generally parallel with one another and having insertion ends pointing generally in the same direction.

11. The clip of claim 10 wherein the mounting portion includes a manual engagement portion that is operatively connected to the pair of mounting pins in manner so that movement of the manual engagement portion by a user causes the pair of mounting pins to move toward their in-use position as a unit.

12. An article holder for releasably holding an article to an adjacent object, the article holder comprising:

an article retaining body having an article-engaging portion adapted for releasably holding an article;

a mounting portion operatively connected to the article retaining body for mounting the article holder to an adjacent object, the mounting portion having at least one mounting prong with an insertion end adapted for insertion in and securement to said adjacent object, said at least one mounting prong being pivotally connected to the article retaining body in a manner so that the mounting prong pivots between a safety position wherein the insertion end of the mounting prong lies generally parallel to and substantially flush against a portion of the article retaining body and an in-use position wherein the insertion end of the mounting prong is spaced from the article retaining body; and a resilient member operatively connected to the article retaining body and mounting portion for biasing the at least one mounting prong toward its safety position.

13. The article holder of claim 12 wherein the resilient member is a compression spring positioned between the article retaining body and the mounting portion.

14. The article holder of claim 13 wherein the mounting portion pivots relative to the article retaining body about a pivot axis, said at least one mounting prong being located on a first side of the pivot axis and said mounting portion having a manual engagement portion located on an opposite second side of the pivot axis, the manual engagement portion being operatively connected to the at least one mounting prong with the compression spring being positioned between the article retaining body and the manual engagement portion, the manual engagement portion having an engagement surface adapted for manual engagement by a user against the bias of the compression spring in a manner to cause the at least one mounting prong to move toward its in-use position.

15. The article holder of claim 12 wherein said mounting portion includes a pair of mounting prongs aligned generally parallel with one another and having insertion ends pointing generally in the same direction.

16. The article holder of claim 15 wherein the mounting portion includes a manual engagement portion operatively connected to the pair of mounting prongs in manner so that movement of the manual engagement portion by a user causes the pair of mounting prongs to move toward their in-use position as a unit.

17. The article holder of claim 12 wherein the article retaining body comprises first and second clamping members, each of the first and second clamping members having a gripping end and a finger-engaging end, the first and second clamping members being pivotally connected to one other for pivoting movement about a pivot axis located between the respective gripping and finger-engaging ends of the first and second clamping members, the first and second clamping members being moveable between a gripping position wherein the gripping ends of the first and second clamping members are brought into engagement with one another and an open position wherein the gripping ends of the first and second clamping members are spaced from one another, the clamping portion including a spring that is operatively connected to the finger-engaging ends of the first and second clamping members in a manner to urge the finger-engaging ends apart, thereby biasing the gripping ends of the first and second clamping members together for releasably holding an article therebetween.

* * * * *